United States Patent [19]

Kelner

[11] Patent Number: 4,803,396

[45] Date of Patent: Feb. 7, 1989

[54] LIGHTBULB ASSEMBLY HAVING LATCHING RETAINING MEANS

[76] Inventor: Gerald Kelner, 4101 N.W. 132 St., Miami, Fla. 33054

[21] Appl. No.: 96,289

[22] Filed: Sep. 14, 1987

Related U.S. Application Data

[63] Continuation-in-part of Ser. No. 922,313, Oct. 23, 1986, abandoned.

[51] Int. Cl.[4] ..... H01R 13/20

[52] U.S. Cl. ..... 313/318; 439/280; 439/282; 439/356; 439/366; 439/750

[58] Field of Search ..... 313/318; 439/611, 619, 439/734, 744, 750, 280, 282, 356, 357, 366

[56] References Cited

U.S. PATENT DOCUMENTS

| | | | |
|---|---|---|---|
| 2,599,361 | 6/1952 | Beal | 339/191.6 |
| 3,182,185 | 5/1965 | Ahroni et al. | 339/176 L |
| 3,396,363 | 8/1968 | Suzuki | 339/176 L |
| 3,671,923 | 6/1972 | Rieth | 339/176 L X |
| 3,805,215 | 4/1974 | Davis, Jr. | 339/176 L X |

*Primary Examiner*—David K. Moore
*Assistant Examiner*—Mark R. Powell
*Attorney, Agent, or Firm*—John Cyril Malloy

[57] ABSTRACT

A lightbulb assembly composed of (a) a lightbulb and base in electrical engagement in (b) a wired plug and (c) a keeper to keep the assembly together; the keeper includes a cap with an opening in the upper surface for passage of the bulb and with the axial face of the cap in engagement with the axial face of the bulb base, and not the bulb, and with the annular portion of the cap having a portion on it for normal hooked-up engagement with a companionate portion on the plug to keep the lightbulb in electrical engagement with the wired plug in normal use.

11 Claims, 2 Drawing Sheets

LIGHTBULB ASSEMBLY HAVING LATCHING RETAINING MEANS

This application is a continuation-in-part or application Ser. No. 922,313, filed Oct. 23, 1986, abandoned.

FIELD OF THE INVENTION

This invention relates to (a) a lightbulb and associated base in assembly and in electrical engagement in (b) a wired plug wherein (c) a keeper, composed of a cap with an opening through which the bulb extends, which maintains the electrical engagement of the lightbulb and its base with the socket; preferably the keeper includes structure to snap-connect to a companionate portion on the plug for normal hooked-up engagement which maintains the lightbulb and base in releasable but locked assembly in the socket and in electrical engagement therewith. Alternatively, a tab and groove friction fit is used to keep the cap on the socket.

BACKGROUND OF THE INVENTION

In the past, there have been numerous types of structures provided to assemble a lightbulb and its base together with an electrically wired socket with the lightbulb being in electrical engagement through the base with electrical connector means in the socket. Conventionally, this included a lightbulb secured to an exteriorly threaded metal base which is in engagement with a threaded recess of a socket in which electrical connections result from the assembly of the lightbulb base and socket. This invention relates to an assembly of a lightbulb and an associated base together with a socket having an electrical connection means in the socket that is electrically interconnected with the lightbulb leads wherein a keeper means is provided to maintain the electrical connection at all normal times. This is especially important, for example, with miniature Christmas tree lightbulbs because, from time-to-time, whether due to wind or other types of jostling forces, a lightbulb out of a string of lightbulbs may electrical disengage. This results in the entire set or string of lightbulbs becoming dark. It is often difficult to locate the particular lightbulb and base which causes the problem and, indeed, many people do not know that this relatively minor problem is the source of an apparent failure of the entire lightbulb set. When this occurs, it is not in fact a major failure, but, rather, due to the electrical disengagement of one lightbulb; nevertheless, many people believe that such light sets are defective and throw the sets away. The result is that highly decorative light sets, particularly miniature light strings have gradually and unjustifiably carried a poor reputation; and the market for them suffers.

OBJECTS OF THIS INVENTION

It is an object of this invention to provide an improved lightbulb with its associated base and an electrically wired socket with electrical means for interengaging and energizing the lightbulb in the socket, wherein a keeper is provided which bears against the lightbulb base on one axial face and which keeper includes a mutually intercooperating, companionate, hooked-up engagement mechanism cooperating with a formed portion on the exterior surface of the socket so that the keeper normally, but releasably, electrically locks the lightbulb and socket together.

It is another object of this invention to provide, in combination, the assembly of a lightbulb and associated base in electrical engagement in a socket wherein a keeper means is provided which bears against the axial face of the lamp base and includes mutually intercooperating means on the socket and the keeper which is simple, inexpensive to manufacture, and well adapted for releasably maintaining the electrical engagement of the lightbulb in the socket in response to all normal use.

In accordance with these and other objects which will become apparent hereinafter, the instant invention will now be described with reference to the accompanying drawings in which:

DESCRIPTION OF THE PREFERRED EMBODIMENT

Figure 2:
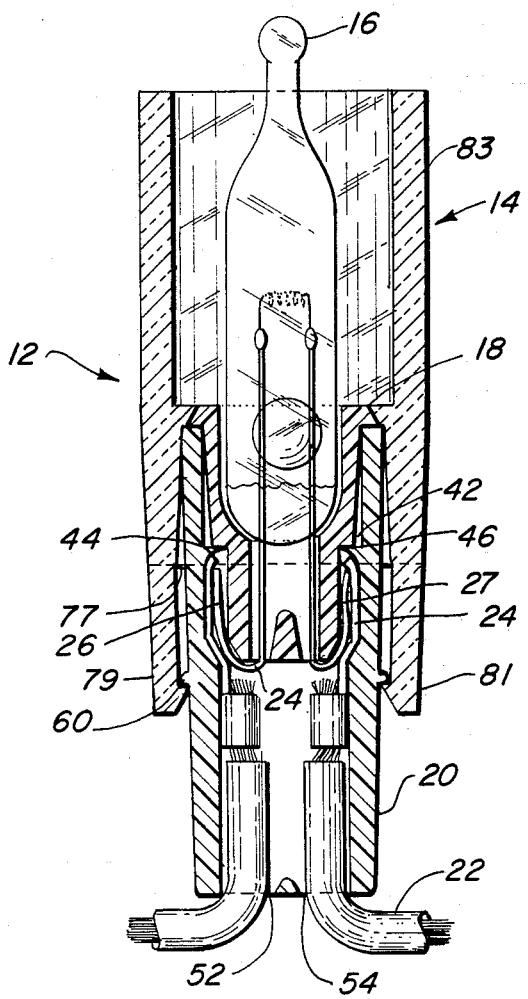
FIG. 2 is a view taken on the plane indicated by the line 2—2 of FIG. 1 and looking in the direction of the arrows.

Referring to the drawings wherein like reference characters designate like or corresponding parts throughout the several views and referring, first, to FIG. 2, it is seen that the assembly, generally, is designated by the numeral 12. It is composed of a keeper 14 which is arranged about a lightbulb 16 and its base 18 to hold it in electrical engagement in a socket member 20.

Figure 1:
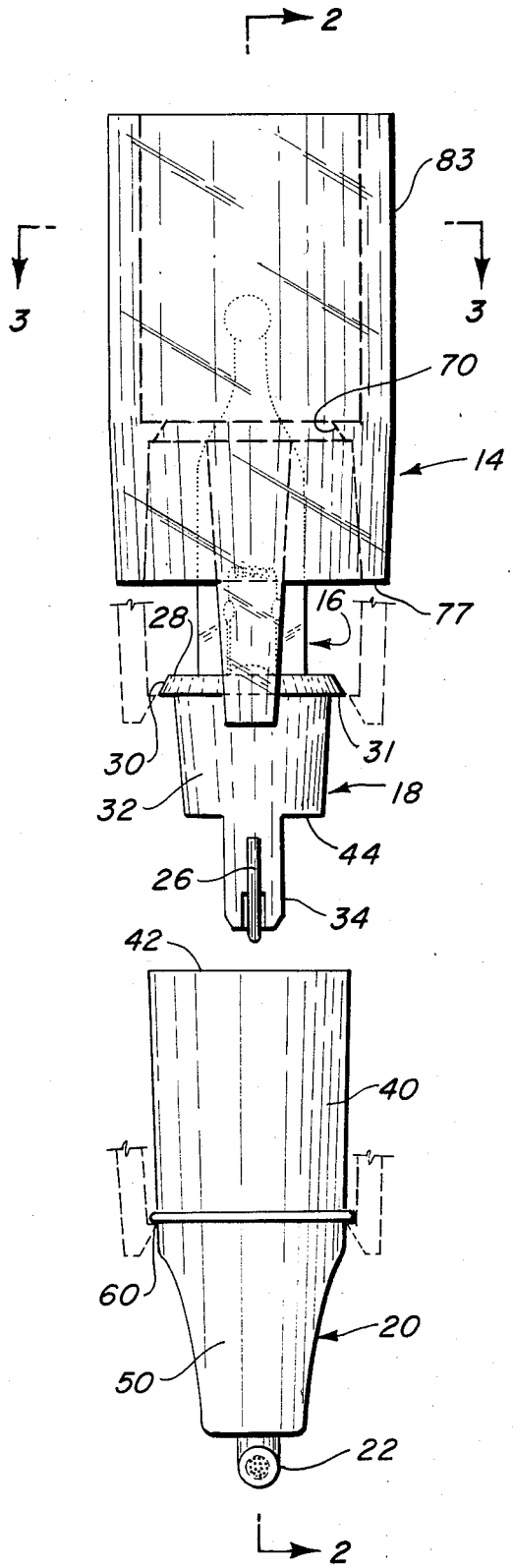
FIG. 1 is an exploded view illustrating the interrelationship of the component parts of the instant invention.
Figure 3:
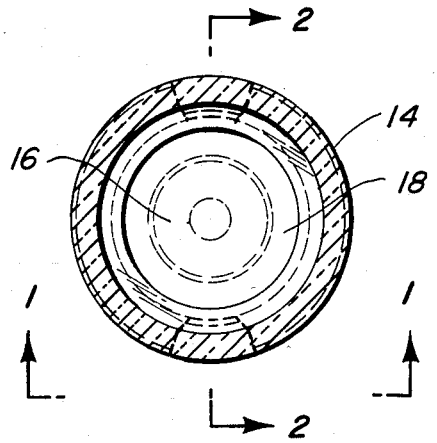
FIG. 3 is a view taken on the plane indicated by the line 3—3 of FIG. 1 and looking in the direction of the arrows.

As seen in FIGS. 1 and 2, the socket is wired as at 22 and the electrical leads 26 and 27 from the filament of the lamp are turned outwardly overlying the exterior surface of the lamp base to accommodate electrical engagement as seen in FIG. 2 of the leads with the socket interior electrical connection means indicated by the numeral 24 in FIG. 2. This is conventional in miniature Christmas lightbulb sets, for example.

The lamp bulb base 18 has an outer axial face 28 of a diameter 30 which is greater than the diameter of the lightbulb 16. The base structure defines a shoulder 31 and it includes an annular body portion which is of a somewhat larger diameter than leading a nose portion 34. In assembly, the annular body portion is seated within the socket with the nose portion extending depthwise into the socket and normally with the leads 26 and 27 in electrical engagement with the socket. The conventional means are as indicated in FIG. 2, that is, with the wires 26 and 27 electrically engaging the electrical connection means 24 of the socket.

Turning now to the socket 20, it is composed of a body 40 with a recess 42 sized and configured to receive the nose 34 and body 32 of the plug with the zone of juncture of the nose and body as indicated by the numeral 44 normally dwelling on a seat 46 in the socket and with the nose portion extending depthwise into it so that the electrical leads are in electrical engagement in the socket as indicated in FIG. 2. The lower portion 50 of the socket conventionally includes openings as indicated at 52 and 54 in FIG. 2 for conductors. Not conventional, however, is a portion 60 on the exterior surface of the socket body which, as is indicated in FIGS. 1 and 2, is adapted for hooked-up engagement with the keeper cap now to be described.

Referring to the keeper 14, seen at the top in FIG. 1, that element will now be described. It is composed of a cap structure with an opening 70 through which the lightbulb passes and which is companionately shaped to bear against the outer axial face of the lamp bulb base outboard of the lightbulb surface 16. Thus, as it is moved axially downwardly, in FIG. 1, the surface 70, an annular inboard portion, will bear against the surface 30 of the lamp bulb base holding it in the socket. The length of the body of the lamp bulb base between the shoulder 31 and its inner end is companionately sized and shaped compared to the socket recess so that the nose portion of the base is received within the portion of the socket having the electrical connector means. On the leading end 77 of the keeper cap legs 79 and 81 extend and include means sized, arranged, configured and located for hooked-up engagement with the outer portion 60 on the body when the keeper ring or inner annulus surface 70 bears against the lightbulb base so that the assembly is maintained in all normal use. In a preferred embodiment, the keeper 14 may include an upwardly extending annular portion 83 comprising a reflector about the lamp as is preferred by some persons when Christmas tree lights are involved. In a preferred embodiment, the base and socket are composed of relatively rigid plastic material as is conventional in the field while the reflector is of rigid plastic transparent or translucent material also as is conventional. It will be appreciated by those skilled in the art that the mutual intercooperating means portion 60 on the exterior surface of the socket 20 is not required to extend completely therearound but may be interupted at a relatively thin portion so that the keeper may be rotated about the longitudinal axis of the assembly and then removed since the hooked-up portion will no longer find an obstruction by reason of the interruption of the portion of the mutually intercooperating means on the exterior surface of the socket. It will be recognized that various types of mutually intercooperating means may be provided on the keeper for hooked-up engagement with the socket in normal assembly; however, in this preferred embodiment, the preferred structure is as shown, composed of a pair of legs each provided with a terminal hook portion for locking engagement with the portion 60.

Figure 4:
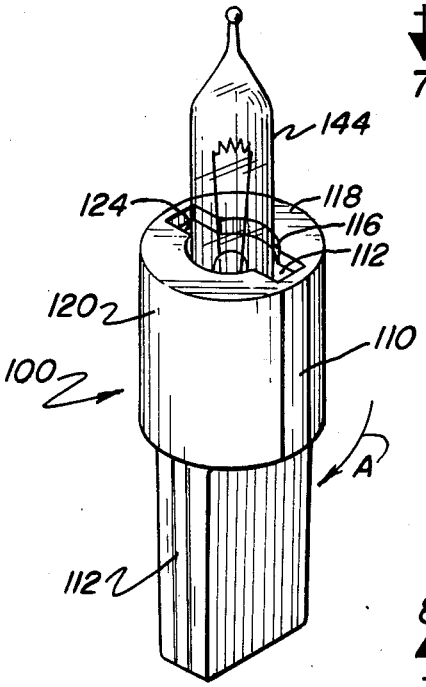
FIG. 4 illustrates an alternate embodiment where the bulb extends through the cap or keeper.
Figure 5:
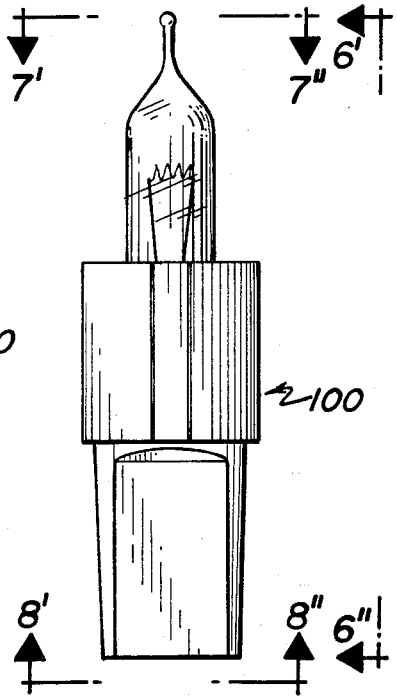
FIG. 5 is a side view of the alternate embodiment.
Figure 6:
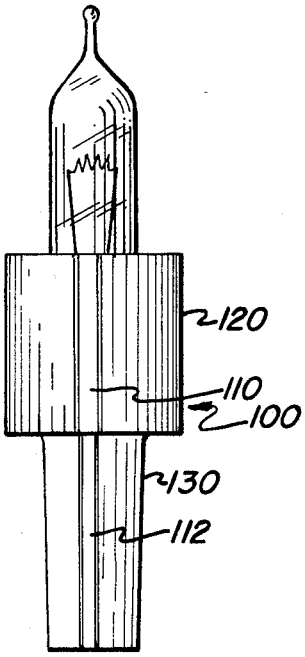
FIG. 6 is a different side view showing the cap in a locked position with the axial indicia on the cap and socket aligned.

FIGS. 4 through 11 show an alternate embodiment of the present invention. This alternate embodiment is discussed in the preceeding paragraph but is discussed in detail hereinafter. FIG. 4 illustrates lamp 100 in an unlocked state wherein indicia grooves 110 and 112 are not axially aligned. Bulb 114 of the lamp extends through circular central region 116 in top 118 of cap 120. Radially extending from circular central region 116 are slots 122 and 124. These slots provide cooling passages for the heat generated by the lamp and circuitry. Central region 116 has a diameter slightly larger than the exterior diameter of lamp 114 thereby also providing additional cooling passages. Cap 120 rotates in direction shown by arrow A to a locking position shown in FIG. 6 wherein indicia 110 on cap 120 is axially aligned with indicia 112 on the exterior of socket 130. FIG. 5 shows a side view of lamp 100.

Figure 7:
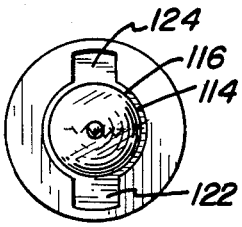
FIG. 7 is a top view of this embodiment.
Figure 8:
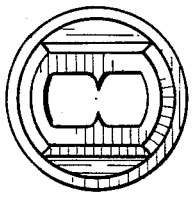
FIG. 8 is a bottom view.

FIG. 7 clearly shows the spacing of lightbulb 114 in central region 116 and radial slots 124 and 122. FIG. 8 shows the bottom view of the lightbulb.

Figure 9:
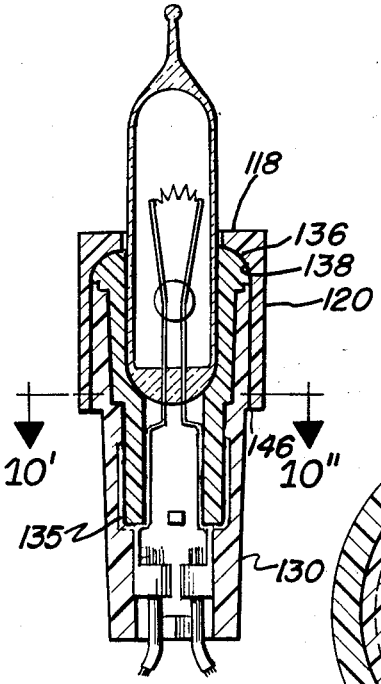
FIG. 9 is a cross-sectional, longitudinal view.

FIG. 9 illustrates a cross-sectional view of the lightbulb. The electrical interconnection of the socket 130 and base 135 are the same manner described earlier with respect to FIG. 2. Cap 120 includes a top 118 having an inner annulus 136 that matches axial face 138 of base 135.

Figure 10:
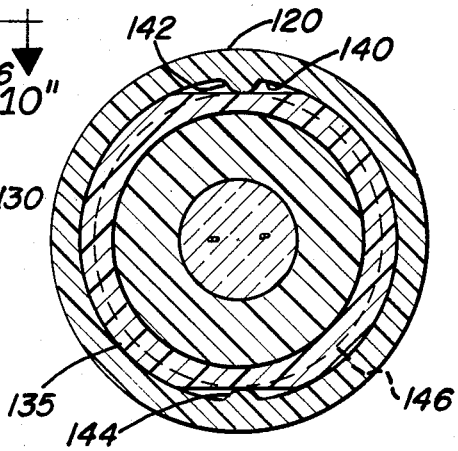
FIG. 10 is a cross-sectional view from the perspective of section lines 10'—10" in FIG. 9 with the cap in an unlocked position; and, FIG. 11 is a cross-sectional view showing the cap in a locked position.
Figure 11:
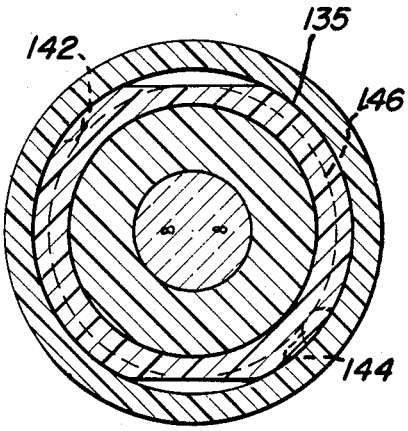

FIGS. 10 and 11 show a cross-sectional view of the lamp in an unlocked and a partially locked position respectively. Protruding from interior surface 140 of cap 120 is a pair of radially inwardly protruding tabs 142 and 144. These tabs cooperate with a groove at the lower underside surface 146 in FIG. 9 and FIG. 10 that latch with the tabs. Therefore, the tabs and the groove 146 form a tongue and groove friction fit between cap 120 and the exterior surface of socket 135. FIG. 11 clearly shows tabs 142 and 144 latched below groove or shoulder 146 of socket 135.

While the instant invention has been shown and described in what is considered to be a practical and preferred embodiment, it is recognized that departures may be made therefrom within the spirit and scope of this invention which is, therefore, not to be limited except as set forth in the claims hereinafter and in accordance with the doctrine of equivalents.

What is claimed is:

1. In combination:

an electrically wired socket including electrical connection means in the socket, a lightbulb with an associated filament, a base, and electrical leads coupled to said filament and extending out of said base, said base being sized and configured for snug receipt in said socket with said electrical leads in electrical engagement with said electrical connection means, said base having an axial face adjacent said bulb of a greater diameter than said bulb, keeper means having a hollow cylindrical form including a lateral portion with an opening through which the bulb extends, said lateral portion having an inner annulus, said inner annulus bearing axially against said axial face of said base outboard of said bulb and, latch means having first and second interengaging portions respectively integrally fixed on said socket and said cylindrical form for normal hooked-up engagement with one another to releasably maintain said lightbulb in said socket at all times in normal use.

2. The device as set forth in claim 1 wherein said keeper means includes a skirt depending from said lateral portion and said latch means includes a pair of legs extending from said skirt axially having barbed ends and said barbed ends normally in hooked-up engagement with said socket exterior.

3. The device as set forth in claim 1 wherein said electrical leads extending through said lamp base are turned back upon the exterior of said lamp base.

4. The device as set forth in claim 1 wherein said axial face of said base is provided with a bevel and said keeper means includes on said inner annulus a companionately sized and configured beveled portion for interengagement with said beveled portion of said base.

5. The device as claimed in claim 1 wherein the top of said cylindrical form is said lateral portion and said bulb extends through said opening of said top.

6. The device as claimed in claim 5 wherein said opening is larger than the exterior diameter of said bulb thereby permitting air flow between said keeper means and said bulb.

7. The device as claimed in claim 6 wherein said opening has a central circular region through which protrudes said bulb and two slots radially extensive from said central region.

8. The device as claimed in claim 1 wherein said keeper means includes a skirt depending from said lateral portion and said latch means includes a tongue and groove fit respectively between the inside of said skirt and the outside of said socket.

9. The device as claimed in claim 1 wherein said keeper means includes a skirt depending from said lateral portion and said latch means includes a pair of tabs radially protruding inward from said skirt which cooperates with a ledge formed in the exterior of said socket.

10. The device as claimed in claim 9 wherein said tabs are oppositely disposed on said skirt.

11. The device as claimed in claim 10 wherein the socket has a pair of flat side surfaces and the interior surface of said skirt except for said tabs is in substantial contact with the exterior of said socket above said ledge except for said side surfaces such that said keeper means is adapted to be axially movable with respect to said socket when said tabs and side surfaces are radially aligned.

* * * * *